United States Patent [19]

Peek

[11] 4,166,938

[45] Sep. 4, 1979

[54] DRIVE FOR HIGH SPEED DISCONNECT SWITCH

[76] Inventor: Henry L. Peek, 136 Whippoorwill Rd., Brandon, Miss. 39042

[21] Appl. No.: 837,161

[22] Filed: Sep. 28, 1977

[51] Int. Cl.[2] ..... H01H 3/30; H01H 3/46

[52] U.S. Cl. ..... 200/153 G; 74/2; 200/153 SC

[58] Field of Search ..... 200/153 G, 153 SC, 148 B; 74/2, 97; 185/40 R

[56] References Cited

U.S. PATENT DOCUMENTS

| | | | |
|---|---|---|---|
| 3,209,101 | 9/1965 | Peek et al. | 200/153 SC |
| 3,778,574 | 12/1973 | Clark | 200/148 B |
| 3,794,798 | 2/1974 | Trayer | 200/153 G |
| 3,794,799 | 2/1974 | Spindle et al. | 200/148 B X |
| 4,020,432 | 4/1977 | Erikson et al. | 200/153 SC X |

*Primary Examiner*—Stephen Marcus

[57] ABSTRACT

Drive for a high speed disconnect switch which attains both high speed closing and high speed opening and requiring one spring for both the closing and opening operation.

13 Claims, 6 Drawing Figures

DRIVE FOR HIGH SPEED DISCONNECT SWITCH

SUMMARY OF THE INVENTION

Disconnect switches that are required to merely carry load currents or short circuit currents and never to interrupt any current at all, can be very slow in operation, for example, taking several seconds to open or close.

However, disconnect switches that are required to open or close against live voltage or to open even magnetizing current or bus charging current must be capable of high speed operation in an opening or a closing operation. This is true because the arcing time must be held to a sufficiently low value to prevent destruction of the switch by continued restriking, which may cause a short circuit to ground, or at the very least cause a drastic reduction in the life of the switch.

It is a general object of this invention to provide an extremely simple, but highly efficient, drive for a high speed disconnect switch.

Another object of the present invention is to provide a single drive mechanism capable of operating the high speed disconnect switches of a three-phase system.

Still another object of the present invention is to provide a high speed drive to speed-up mini-sub disconnect switches to enable them to adequately handle bus charging currents and transformer magnetizing currents.

Yet another object of the present invention is to provide a drive arrangement which combines a slow speed gear motor drive with a single overcenter spring to operate a single-phase or polyphase switch and to cause the switch to move fast in the first part of the opening stroke wherein contacts part at high velocity and fast in the last part of the closing stroke wherein contacts make or engage at high velocity.

An example of a disconnect switch which will permit the isolation of certain sections of a gas insulated system is set forth in U.S. Pat. No. 3,778,574 issued Dec. 11, 1973, to Thomas F. Clark, and assigned to the assignee of the present application. In U.S. Pat. No. 3,794,799 there is disclosed an overcenter spring mechanism, which has a lost motion connection with the lever assembly for actuating the contact shaft of a switch.

DESCRIPTION OF THE PREFERRED EMBODIMENT

Figure 1:
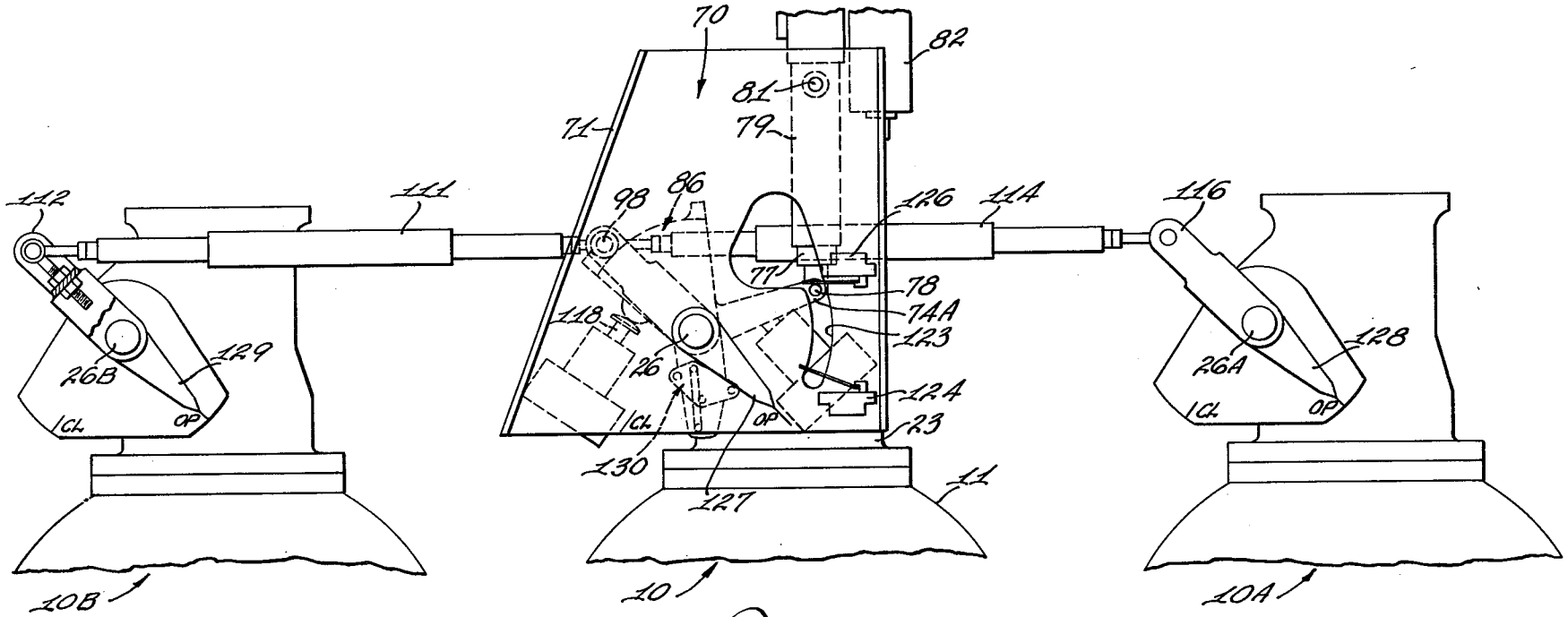
FIG. 1 is a fragmentary view in elevation showing disconnect switch housings and interlinked operating mechanisms for a three-phase gas insulated mini-sub installation in which the present invention is incorporated.

The present invention is particularly applicable to a high voltage substation which may be a three-phase installation as indicated in FIG. 1 by the showing of three disconnect switch housings 10, 10A and 10B (one for each phase). As previously mentioned, the present invention is related to a disconnect switch 10 which includes a housing 11. The description given herein will be directed to the center phase disconnect switch 10 with the understanding that the other disconnect switches 10A and 10B are similar and are operatively interlinked as will be more apparent.

Figure 2:
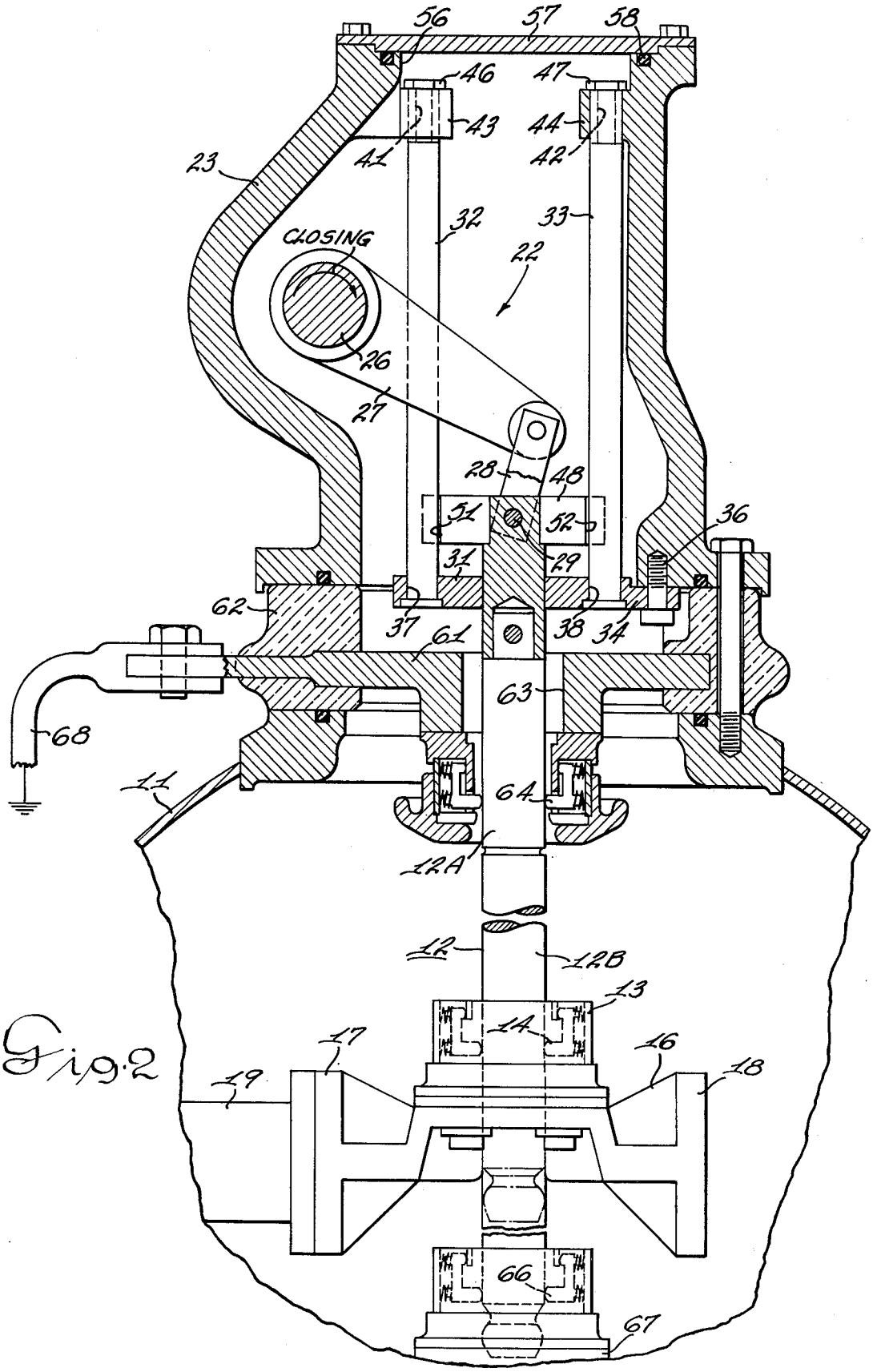
FIG. 2 is a view partly in section and partly in elevation through a disconnect switch of FIG. 1.

The disconnect switch 10 includes a contact rod 12 which when the switch is closed as depicted in FIG. 2, provides for a continuity of the electrical circuit. The contact rod 12 includes an upper insulated portion 12A. The lower end of the contact rod 12 engages in a contact 13 which includes a plurality of radially disposed inwardly biased contact fingers 14 carried by a terminal bracket 16. The terminal bracket 16 is provided with a pair of diametrically opposed electrical interconnecting pads 17 and 18 only one of which is utilized in the present illustrative embodiment. The pad 17 receives the end of the bus conductor 19.

Movement of the contact rod 12 is effected by means of an operating mechanism 22 contained within a sealed housing 23 attached to the external surface of the switch housing 11. The operating mechanism 22 includes a crank shaft 26 which extends through the wall of the enclosure 23 being journalled therein in sealed relationship to provide a gas-tight rotatable joint. The end of the crankshaft 26 within the enclosure 23 receives one end of a crank arm 27 which is secured in position so as to rotate with the crankshaft. The opposite end of the crank arm 27 is pivotally connected to one end of a pivot link 28. The opposite end of the pivot link 28 is pivotally connected as at 29 to the upper end of the contact rod 12.

Vertical guides are provided to maintain the contact rod 12 in vertical position as it is moved axially. To this end a guide bracket 31 is provided which supports a pair of spaced vertically extending guide rods 32 and 33. To secure the guide rod bracket 31 in position within the enclosure 23, the bracket is formed with a radially extending flange portion 34 through which a plurality of screws 36, one of which is shown, extend into threaded engagement with the axial end of the enclosure casing 23. As shown in FIG. 2, the guide rods 32 and 33 extend upwardly through openings 37 and 38 formed in the bracket 31 passing through axially aligned bores 41 and 42 formed in a pair of inwardly extending bosses 43 and 44 that are an integral portion of the enclosure casing 23. Threaded cap members 46 and 47 are threadably engaged on the upper end of the rods 32 and 33 to lock the rods in position. A guide block 48 is secured to the upper end of the contact rod 12 and is provided with a pair of diametrically disposed vertical guide slots 51 and 52. As shown in FIG. 2, the guide slots 51 and 52 cooperate with rods 32 and 33, respectively, to maintain the contact rod 12 in guided vertical position as it is moved axially.

An access opening 56 formed in the top of the enclosure 23 is sealed in a gas-tight manner by a removable plate 57. An O-ring 58 serves to prevent gas leakage between the cover plate 57 and the casing 23.

The contact rod 12 is passed through a grounding ring 61 which is molded into the internal wall of an insulator spacer 62. An axial bore 63 is formed in the spacer 61 to permit free movement of the contact rod. In the particular illustration, selective grounding between the contact rod 12 and grounding ring 61 is established by means of a contact cluster 64 through which the rod 12 passes. The contact cluster 64 is secure in electrical conducting relationship to the axial extending hub of the ring 61. With the contact rod 12 in its lowermost position, or closed position as depicted in FIG. 2, an electrical path is established between the bus conductor 19 and a contact cluster 66 which is electrically connected to a bus 67. In this position, a conductive portion 12B of the contact rod extends through the contact cluster 14 and into the contact cluster 66 to complete a circuit between the buses 19 and 67. At this time an insulated portion 12A of the contact rod is within the grounding contact cluster 64. To open the switch to interrupt the electrical continuity, the contact rod 12 is moved axially upwardly by the operating mechanism 22. This action withdraws the contact portion 12B from the cluster 66 but still remains within the contact cluster 14. Under this condition the upper end of the contact rod portion 12B is within the grounding contact cluster 64 to establish a grounding circuit via a ground strap 68 connected to the ground ring 61.

As previously mentioned switch 10 must be capable of high speed operation both in opening and in closing. It is especially desirable to have the switch move fast in the first part of the opening stroke and to move fast in the last part of the stroke in a closing movement. To this purpose a drive mechanism 70 is operably connected to the crankshaft 26 of the center phase disconnect switch 10. As shown in FIG. 1, the drive mechanism 70 is also connected to operate the crankshafts 26A and 26B associated with the operating mechanisms associated with the other two phases.

Figures 3, 4:
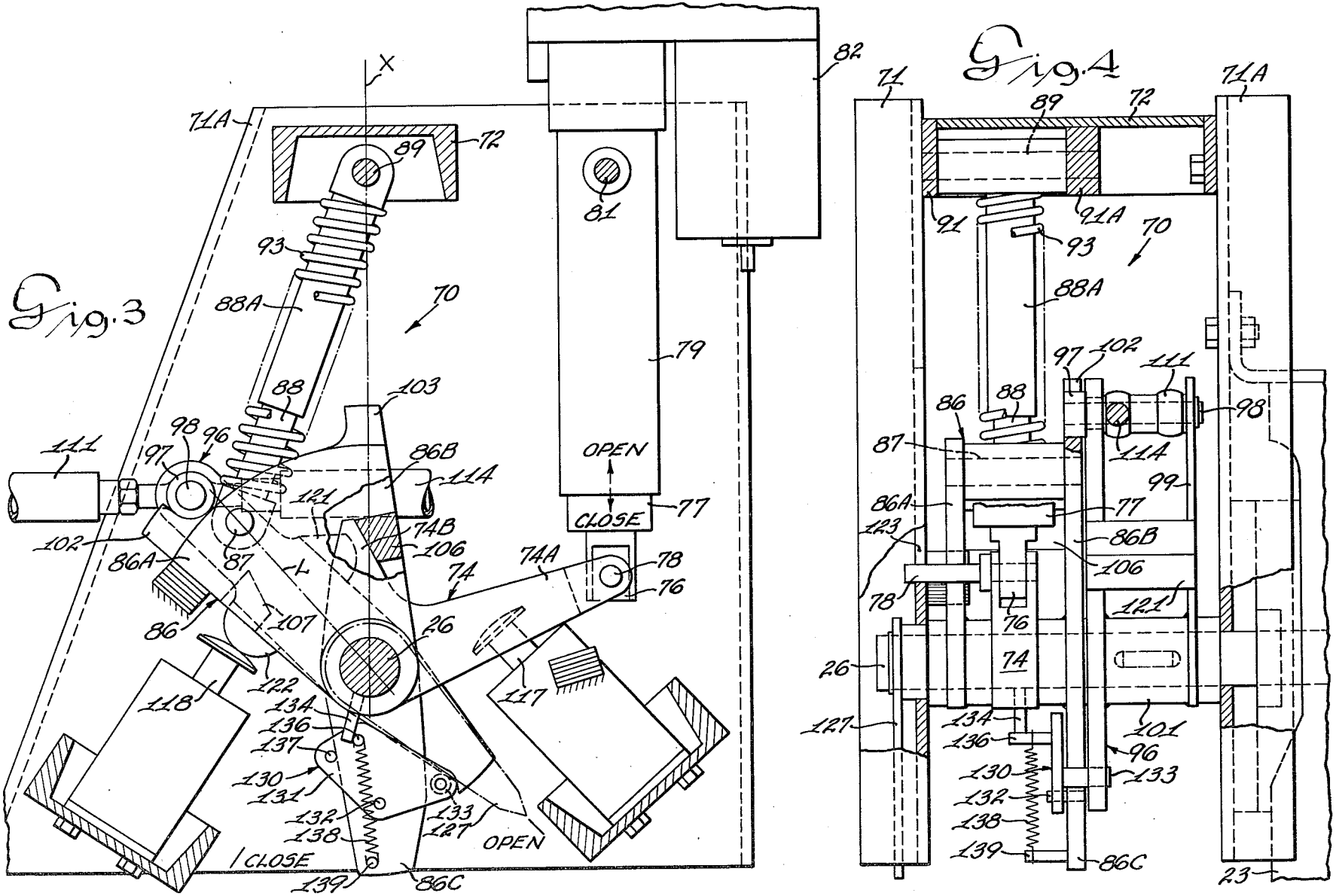
FIG. 3 is a view in side elevation with parts broken away to show the operating mechanism for the high speed drive arrangement, the drive mechanism components being shown in a condition wherein the disconnect switch contacts are in open position.
FIG. 4 is a view in right side elevation of the drive mechanism of FIG. 3 with parts broken away to more clearly show construction when the components are in midposition.

As best shown in FIGS. 3 and 4, the drive mechanism 70 is operably disposed between a pair of spaced-apart vertical plate members 71 and 71A. The plate members 71 and 71A are secured in upright positions on the operating mechanism housing 23 as best shown in FIG. 1. A reinforcing spacer bar 72 serves to maintain the top portion of the plates in spaced-apart relationship. The crankshaft 26 extends outwardly of the operator housing 23 and through suitable aligned openings provided in the plates 71–71A. A motor drive crank 74 is mounted on the crankshaft 26 so as to be freely rotatable on the crankshaft. The motor drive crank 74 is an L-configured member having a relatively long arm portion 74A and a relatively short arm portion 74B which is at substantially 90° with respect to the arm portion 74A. The end of the arm portion 74A is formed as a clevis and receives the free end 76 of an axially movable thruster rod 77. A clevis pin 78 pivotally secures the two members together. The thruster rod 77 is movably supported in a housing 79 which is supported for pivotal movement between the plates 71 and 71A by means of laterally extending stub shafts 81, one of which is shown. A gear motor 82 is coupled to the thruster housing 79 to pivot with the housing and is also operably connected in a well-known manner to effect axial movement of the thruster rod 77.

The motor drive crank 74 which is free to rotate on shaft 26 will operate, when rotated in a clockwise direction, as viewed in FIG. 3, to start to move a spring drive crank 86. To this purpose the spring drive crank 86 is formed as a pair of spaced-apart members 86A and 86B with the inner or right hand member 86B, as viewed in FIG. 4., including an oppositely extending portion 86C. Extending between the two portions 86A and 86B is a pin 87. The pin serves to pivotally secure one end of a telescoping springshaft 88 to the spring drive crank 86. The opposite end of the springshaft 88 is pivotally secured to a pin 89 carried between bracket members 91 and 91A which are welded to the spacer bar 72. Thus, as the spring drive crank 86 is caused to move in a clockwise direction, the springshaft 88 will telescope within its associated housing 88A allowing the spring 93 to compress so as to become loaded. When the spring drive crank 86 has been moved to a position wherein an imaginary line L, which passes through the axes of the pin 87 and the shaft 26, is slightly past the vertical axis X, the stored energy in the spring 93 will operate to forcefully and at a considerable speed impel the spring drive crank 86 in clockwise direction.

Advantage of this movement has been taken to rotatively drive the crankshaft 26 to effect an opening operation of the operating mechanism 22 for opening the disconnect switch. To this end a switch crank 96 is mounted on and keyed to the shaft 26 so as to effect its rotation when it is moved. Pivotal movement of the switch drive crank 96 is effected by means of a boss 97 which is welded to switch drive crank 96 and cooperates with abutment 102 to close and abutment 103 of spring drive crank 86B to open disconnect switch. Pin 98 extends through the upper end of the switch drive crank 96 and the upper end of a support arm 99 which is connected as by means of a central hub 101 to move with the switch drive crank 96. To impart motion to the boss 97 and thereby pivot the switch drive crank 96, the upper sector-like portion of the inner member 86B of the spring drive crank 86 the central peripheral portion thereof is relieved which forms end stops or abutments 102 and 103. The boss 97 associated with the switch drive crank 96 is positioned so as to clear the arcuate surface of the relieved portion of the inner members 86B between the stops 102 and 103. Thus, as the spring drive crank 86 is pivoted in a clockwise direction, the stop 102 forces the boss 97 and thereby the switch drive crank 96 to move with it in the same direction. Therefore, as previously mentioned, when the spring drive crank 86 is positioned so that the imaginary line L is slightly past the line of centers X which passes through the axis of shaft 26 and the axis of pin 89 the stored energy in the compressed spring 93 will forcefully impel the spring drive crank 86 in a clockwise direction at a relatively high rate of speed. This, in turn, will effect the rapid movement of the switch drive crank 96 thereby rotating the shaft 26 to effect a rapid closing movement of the disconnect switch.

The motor drive crank 74 imparts its rotational movement to the spring drive crank 86 as previously stated. This is accomplished by means of closing push bar 106, against which the short arm portion 74B of the motor drive crank 74 engages. Thus as the motor drive crank 74 is pivoted in a clockwise direction, as viewed in FIG. 3, the arm portion 74B of the motor drive crank 74 pushes against the bar 106 forcing the spring drive crank to pivot on the shaft 26 in the same direction. For the opening operation an opening push bar 107, which spans the members 86A and 86B of the spring drive crank, is provided against which the arm portion 74B pushes when the motor drive crank 74 is caused to pivot in a counterclockwise direction to an open position.

The drive mechanism 70 is also operable to effect the simultaneous operation of the disconnect switches 10A and 10B associated with phases 1 and 3. To this purpose, one end of an actuating tie or connecting rod 111 is connected to the pin 98 and has its opposite end connected to a switch drive crank 112 associated with the drive shaft 26B which is associated with the phase 3 disconnect switch 10B as shown in FIG. 1. In a similar manner another actuating tie rod 114 is connected to the pin 98 and has its opposite end connected to a switch drive crank 116. The drive crank 116 is connected to rotate the drive shaft 26A associated with the phase 1 disconnect switch 10A. Thus, when the switch drive crank 96 is operated to effect rotation of the drive shaft 26 all the drive shafts are operated simultaneously.

The final movement of the spring drive crank 86 in a switch closing or opening direction of operation is accompanied with considerable force that can damage the components. To absorb the forces expended there are provided shock absorbing stops 117 and 118. For this purpose the switch drive crank 96 is provided with oppositely extending bumpers 121 and 122. The bumper 121 is positioned so as to strike the yieldable plunger of the absorber 117 when the switch drive crank is pivoted in a clockwise direction in a switch closing movement. On the other hand the bumper 122 is so positioned as to strike the yieldable plunger of the absorber 122 when the switch drive crank is pivoted in a counterclockwise direction in a switch opening movement.

As previously mentioned, operation of the drive mechanism 70 is initiated by the operation of the gear motor 82. In a switch closing operation the gear motor 82 is energized either automatically by a signal from a source in a well-known manner or manually as desired. When energized the gear motor 82 affects axial downward movement of the thruster rod 77, as viewed in FIG. 3, thereby initiating operation of the drive mechanism 70. The gear motor is geared at about 55:1; thus, the motor drive crank 74 will be pivoted in a clockwise direction at a relatively slow rate from the position it occupies as depicted in FIG. 3 towards the position depicted in FIG. 5. This initial movement of the motor drive crank 74 at a relatively slow rate of speed is desirable because it is unnecessary for the first portion of the closing stroke to be fast. However, as the switch gap approaches prestrike length, the relative movement between the contacts must be fast enough to reduce prestrike arcing time to a minimum. Thus, as the motor drive crank 74 is moved at a relatively slow rate it, in turn, drives the spring drive crank 86 in a clockwise direction at a relatively slow rate. This is accomplished because as the motor drive crank 74 is rotated in a clockwise direction the short arm portion 74B thereof engages the push bar 106 forcing the spring drive crank 86 to pivot on the shaft 26 in a clockwise direction. As the spring drive crank 86 pivots in a clockwise direction, the end tab 102 applies against the roller 97 forcing the switch drive crank 96 in a clockwise direction. With the slow rotational movement imparted to the shaft 26 by reason of the pivotal movement of the switch drive crank 96, the shaft 26 will be rotated to move the contact rod 12 downwardly from an elevated switch open position.

Figure 6:
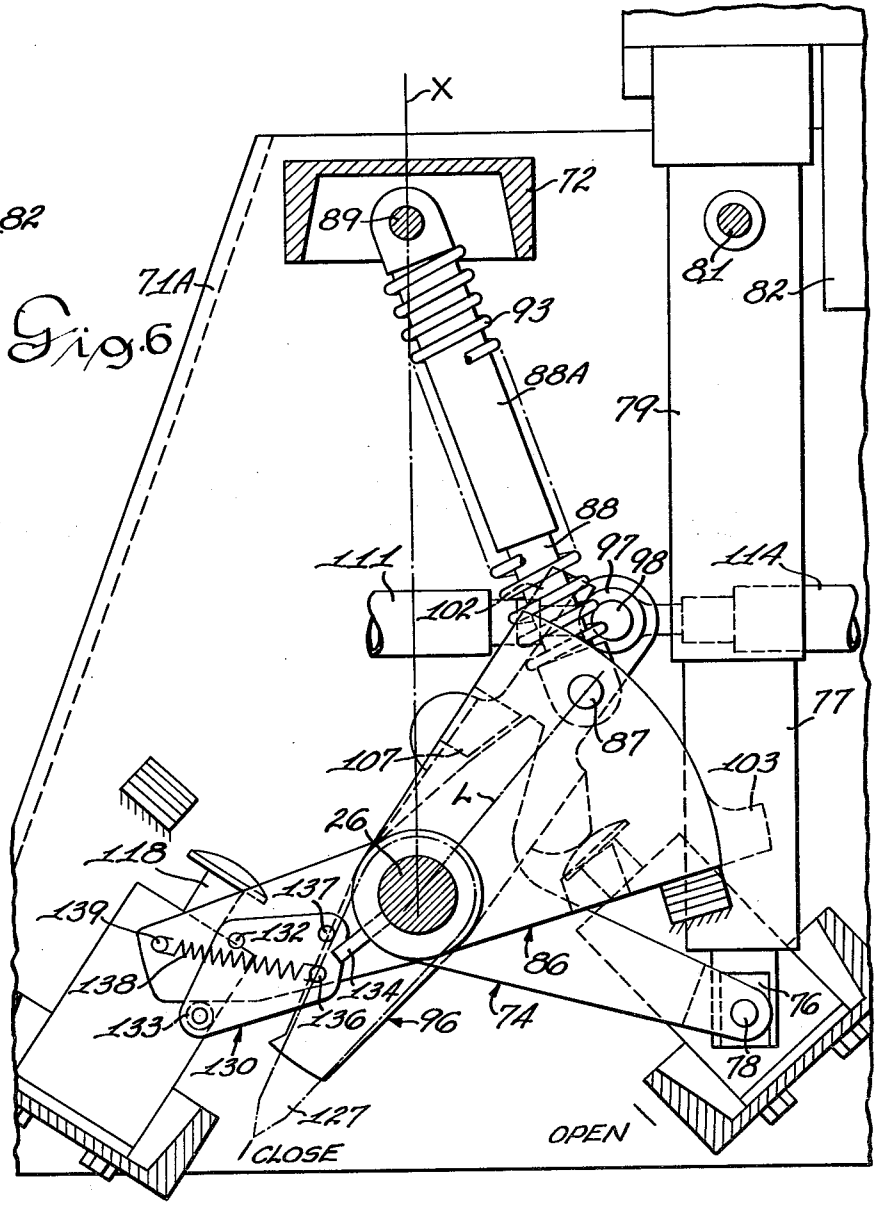
FIG. 6 is a view in side elevation similar to FIG. 3 showing the components with the switch in closed position.
Figure 5:
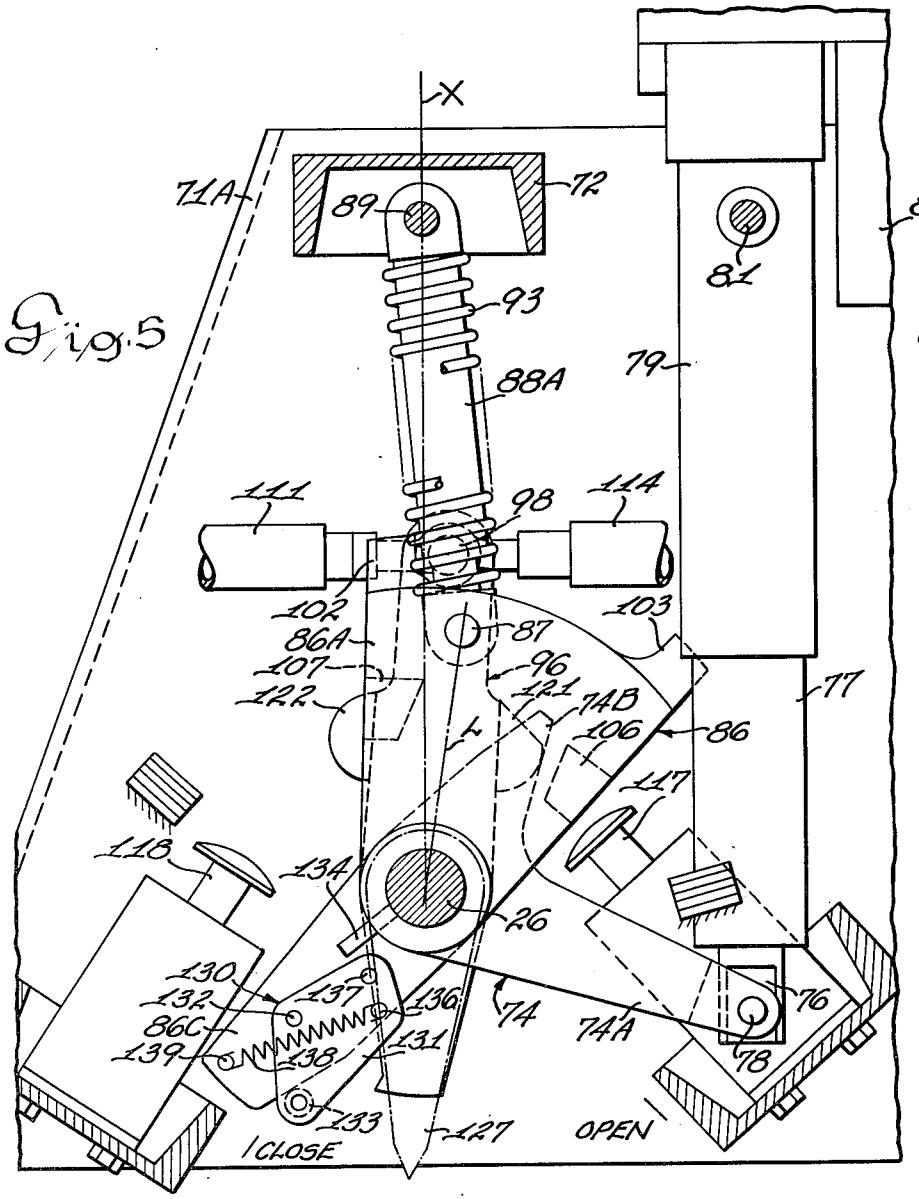
FIG. 5 is a view in side elevation similar to FIG. 3 but showing the drive mechanism components in a position of overcenter as the switch is being actuated to a closed position.

At a point in travel of the motor drive crank 74 it will be in the position that it occupies as depicted in FIG. 5. At this time, the extension of pin 78 which extends through an arcuate slot 123, FIG. 1, formed in side plate 71 actuates a limit switch 124 to deenergize the gear motor 82. Limit switch 124 is secured to the outer surface of plate 71 in position to be in the path of travel of pin 78. This action occurs soon after the spring pin 87 is past or to the right of the vertical line of centers X, as viewed in FIG. 5. The gear motor 82 when deenergized will coast to a stop with only a few degrees of rotation of the motor drive crank 74 by reason of friction in its gearing. Thus, with the pin 87 past the line of centers X between shaft 26 and pin 98, the spring 93 which is fully compressed at the line of centers X now delivers a clockwise movement to spring drive crank 86 which is transmitted through end tab 102 to switch drive crank 96. This causes switch drive crank 96 to be driven rapidly the last half of the closing stroke through the prestrike zone to a switch closed position as shown in FIG. 6. In the fully closed position, the short arm portion 74B of the motor drive crank 74 is in the position depicted in FIG. 6.

The drive motor 82 is reversible and when energized for operation in a switch opening movement, the motor drive crank 74 will be rotated in a counterclockwise direction as viewed in FIG. 6. The short arm portion 74B rotates from the position it occupies as depicted in FIG. 6 and engages the pushbar 107 to drive spring drive crank 86 in a counterclockwise direction. After driving the spring drive crank 86 a distance in the counterclockwise direction the end tab 103 will have moved from the position it occupies, as depicted in FIG. 6, to engage with the boss 97 to start the switch drive crank 96 in a counterclockwise direction of movement, from its switch closed position toward the switch open position. At the same time, the spring pin 87 carried by the spring drive crank 86 will have reached the vertical line of centers X which passes through the centers of pins 26 and 89. As the spring drive crank 86 is driven counterclockwise slightly past the vertical line of centers X the now fully compressed spring 93 provides a sufficient counterclockwise moment to overcome the friction between the switch contacts and drives them rapidly during the first half of the opening stroke. The contact velocity obtained by operation of the spring 93 is sufficient by the time contacts part and is further accelerated to mid-stroke so that the arcing time is reduced to a low value, thus limiting the deterioration of both the contacts themselves and arcing medium; such as, the $SF_6$ insulating gas within the enclosure 11.

The gear motor 82 is deenergized soon after the spring 93 is driven past the line of centers X by operation of the extending end of pin 78 actuating an upper limit switch 126. The movable contact 12 of the switch is accelerated only during the first half of its opening stroke and the kinetic energy attained during this first half of the stroke carries it rapidly to the fully open position. During the closing stroke, the contacts move slowly during the first half, but are accelerated rapidly through the last half of the stroke which includes the prestrike zone.

Visual indication of the disconnect switch condition is afforded by means of an indicator arm or pointer 127 which is secured to the outer extending end of the shaft 26. Indicators 128 and 129, FIG. 1, are provided for the disconnect switches 10A and 10B, respectively. Thus, when the drive mechanism 70 is operated to effect an opening or closing of the disconnect switch 10 it also operates the disconnect switches 10A and 10B and each has its own indicator.

It will be noted that at the end of the closing stroke of switch drive crank 96 any rebound of crank 96 is limited by action of spring 93 acting on spring drive crank 86 because end abutment 102 is in contact with the boss 97 carried by the switch drive crank 96, as depicted in FIG. 6. However, at the end of the opening stroke, the end abutment 103 of the spring drive crank 86 is not in a position of engagement with the boss 97 of switch drive crank 96, and, therefore, cannot prevent rebound of the crank and the disconnect switch contacts. To limit the rebound of the switch contacts when in the open position, a unique latching arrangement 130 is provided.

As shown in FIG. 3, the latching device 130 includes a latch plate 131 which pivots on a pin 132 carried by the switch drive crank 86 at the lower end thereof. In the switch open position, as depicted in FIG. 3, a pin 133 which is fixed in the latch plate 131 to extend to the rear thereof, is in an interference position between the lower ends of the spring drive crank 86 and the switch drive crank 96 and any attempt of the switch drive crank 96 to rebound in a clockwise direction toward the switch closed position will cause the pin 133 to engage against the spring drive crank inner member 86B and drive the crank 86 in a clockwise direction, as viewed in FIG. 3. This action will start to compress spring 93 which will resist the rebound effort and will force the switch drive crank 96 back to its fully open position.

It will be recalled that during a switch closing operation, motor drive crank 74, spring drive crank 86 and switch drive crank 96 all move together in a clockwise direction until slightly beyond half stroke wherein the axis of spring 93 has moved through and to the opposite side of the line of centers X. At this point of travel spring drive crank 86 and switch drive crank 96 under the influence of the stored energy of spring 93 continue to move together in a clockwise direction for the last half of the opening movement stroke, while the motor drive crank 74 stops. After the time that the motor drive crank 74 stops and spring drive crank 86 continues to move in the clockwise direction, a pin 134, which extends radially outwardly of the hub of the motor drive crank 74, causes a pin 136 which is fixed in the latch plate 131 to rotate clockwise, as viewed in FIG. 3, about pin 132 which of course effects the displacement of pin 133 and a pin 137 carried by the latch plate 131 in a clockwise direction into the position as depicted in FIG. 6.

Because of the foregoing action a pin 136 which is fixed to the latch plate 131 will be moved relative to spring drive crank 86 to the position it occupies as depicted in FIG. 6, and pin 133 stops against spring drive crank 86. At this time, a spring 138 fixed between pin 136 and a pin 139 will have its axis displaced to the right, from the position it occupies as shown in FIG. 3 to the angular position as depicted in FIG. 6. Thus, the spring 138 now acts to hold the latch plate 131 in the clockwise position through approximately the last half of clockwise travel of spring drive crank 86 towards the switch closed position.

During the spring charging portion of the opening stroke, the motor drive crank 74 and the spring drive crank 86 are moving counterclockwise together so that there is no relative motion between them and the spring 138, the pins 136 and 133 remain in the position, as depicted in FIG. 6, relative to spring drive crank 86. Switch drive crank 96 remains stationary in the position depicted in FIG. 6 during this time as pin 133 moves to the position it occupies, as shown in FIG. 6, passing below the lower end of the switch drive crank 96 without interference. After motor drive crank 74 stops, spring drive crank 86 continues to move under the force of spring 93, and pin 134 on motor drive crank 74 will engage pin 137 and reset the latch plate 131 to its original position depicted in FIG. 3. Pin 133 stays below the end of switch drive crank 96 until it is in full switch open position where it moves into interference position between cranks 86 and 96 and causes interference between spring drive crank 86 and switch drive crank 96 to limit the rebounding of switch drive crank 96 from its overtravel position at the end of the opening stroke.

From the foregoing detailed description of a high speed drive mechanism for a disconnect switch in which advantages have been incorporated for obtaining the highly desirable operating characteristics of both high speed closing and high speed opening which results are obtained positively. The drive mechanism disclosed is capable of effecting switch operation of a three-phase installation.

The embodiments of the invention in which an exclusive property or privilege is claimed are defined as follows:

1. In a gas insulated switch having a gas tight enclosure in which a first contact and a second contact are located for opening and closing movement relative to each other;

a drive shaft extending into said gas tight enclosure and being operably connected to effect relative movement between said contacts in a switch closing operation and in a switch opening operation when operated in a first direction and in a second direction respectively, said drive shaft having a switch drive crank affixed thereto, a drive mechanism operably connected to effect the movement of said drive shaft in one direction or the other selectively when actuated and including a spring drive crank rotatable about the axis of said drive shaft and having a lost motion connection with said switch drive crank, stored energy means including an overcenter compression spring having one end pivoted at a fixed point and being pivotally connected at its other end to said spring drive crank and being operably connected to be charged by the operation of said drive mechanism, reversible power means operably connected to initiate the operation of said drive mechanism to a position wherein said compression spring has been charged and moved overcenter and said drive shaft has been moved sufficiently far to have effected relative movement of said contacts to a point short of an open position when said shaft is rotated in said second direction and to a point short of engagement of said contacts when said shaft is rotated in said first direction, and means to render said power means inactive when said compression spring has been moved overcenter in either direction of rotation of said shaft;

said stored energy means operably connected to effect the final operation of said drive mechanism after said power means has been inactivated and to effect rapid movement of said contacts relative to each other to open position and to closed position respectively when said drive shaft is operated in said second direction and in said first direction.

2. A gas insulated switch according to claim 1 wherein said means operably connected to initiate the operation of said drive means includes a gear motor and a mechanical linkage connected to said drive mechanism.

3. A gas insulated switch according to claim 2 wherein said mechanical linkage includes a telescoping thruster rod connected to be actuated axially by said gear motor.

4. A gas insulated switch according to claim 3, wherein there is provided support structure secured to the external surface of the switch enclosure and said drive mechanism is secured to the supporting structure with the outwardly extending end of said drive shaft being supported by said support structure and said thruster rod and gear motor are also operably supported by said supporting structure.

5. In a gas insulated switch having a gas tight enclosure in which a first contact and a second contact are located for opening and closing movement relative to each other and the external surface of which provides a support structure, a drive shaft extending into said gas tight enclosure, means for effecting relative movement between said contacts in a switch closing operation and in a switch opening operation when said drive shaft is rotated in first and in second directions respectively, a drive mechanism operably connected to effect rotation of said drive shaft in one direction or the other selectively and being secured to said supporting structure with the outwardly extending end of said drive shaft supported by said support structure, overcenter spring stored energy means operably connected to be charged by the operation of said drive mechanism, power means operably connected to initiate the operation of said drive mechanism to a position wherein said drive shaft has moved sufficiently far to actuate said stored energy means overcenter and to have effected relative movement of said contacts to a point short of an open position when said drive shaft is rotated in said second direction and to a point short of engagement of said contacts when said drive shaft is operated in said first direction and including a gear motor and a telescoping thruster rod connected to be actuated axially by said gear motor, means to disable said power means after said stored energy means has been moved overcenter in either direction of rotation of said shaft, said stored energy means effecting the final operation of said drive mechanism after said power means has been disabled to rapidly move said contacts relative to each other to open position when said shaft is rotated in said second direction and to rapidly close said contacts when said shaft is rotated in said first direction, and wherein said drive mechanism includes a switch drive crank mounted on said drive shaft and connected thereto to effect its rotation;

a spring drive crank mounted on said drive shaft for pivotal movement relative to said drive shaft;

means operably connected between said spring drive crank and said thruster rod to transmit motion to said spring drive crank from said thruster rod;

means connecting said stored energy means to said spring drive crank; and means operating between said spring drive crank and said switch drive crank; whereby the stored energy means will provide sufficient moment to the switch drive crank to effect its operation and drive said drive shaft for moving said switch contacts rapidly relative to each other in a switch closing operation and in a switch opening operation.

6. A gas insulated switch according to claim 5 wherein said means operably connected between said spring drive crank and said thruster rod is a motor drive crank pivotally mounted on said drive shaft; and pick-up means on said spring drive crank engageable by said motor drive crank as it is pivotably moved by said thruster rod to enforce movement of said spring drive crank to a position wherein said stored energy means becomes operable to drive said spring drive crank in a switch opening or closing operation.

7. A gas insulated switch according to claim 6 wherein said stored energy means is arranged to act on said spring drive crank to impart a force thereto at a predetermined point in travel of said motor drive crank and said spring drive crank imparts a movement to said switch drive crank to operate the drive shaft in a contact opening or closing operation.

8. A gas insulated switch according to claim 5 wherein said stored energy means comprises a compression spring having one first end anchored to a pin carried by said supporting structure and the second end of said spring being connected to a pin carried by said spring drive crank, the end of said spring which is connected to the pin carried by said spring drive crank being normally displaced to one side or the other of a line which passes through the axis of said drive shaft and the pin to which the first end of said spring is connected;

whereby the initial movement of said spring drive crank compresses said spring and starts the movement of said switch contacts relative to each other at a relatively slow rate and the further movement of said spring drive crank moves the second end of said spring to the opposite side of the line which passes through said drive shaft and the pin to which the first end of said spring is anchored to thereby effect the release of the stored energy in said spring to drive said spring drive crank at a relatively fast rate to effect the further movement of said switch contacts relative to each other at a relatively rapid rate.

9. A gas insulated switch according to claim 8 wherein there is provided latching means pivotally carried by said spring drive crank and having means thereon to engage with the switch drive crank to limit the rebound of the switch in the direction of switch closed position, and wherein such attempt to rebound compresses said spring which thereupon operates to resist a rebound movement of the switch drive crank and forces the switch drive crank to return to its full open position.

10. In a drive for a high speed disconnect switch of at least one phase of a three-phase gas insulated substation having gas-insulated components which include the disconnect switch; said disconnect switch including a gas tight enclosure in which the disconnect switch contacts are disposed for movement relative to each other in a switch opening or closing operation, said disconnect switch also including a drive shaft connected to effect the movement of the contacts relative to each other, the drive shaft having one end extending outwardly of said gas tight enclosure;

a supporting frame secured to the enclosure;

a power actuator carried by said supporting structure;

a motor drive crank mounted on the extending end of the drive shaft, said motor drive crank being rotatable on said drive shaft;

connecting means operable between said power actuator and said motor drive crank to effect the pivotal movement of said motor drive crank when said power actuator is operated;

a spring drive crank mounted on the drive shaft for rotation relative to the drive shaft;

a compression spring having a first end pivotally anchored to said supporting structure and spaced from said drive shaft, the arrangement being such that a line passing through the anchor point of said first end and the axis of said drive shaft serves as a line of centers through which the axis of said spring moves to effect the operation of said drive shaft in a contact opening or closing operation;

a switch drive crank mounted on said drive shaft and connected to effect the rotation of said drive shaft;

engaging means operably carried by said switch drive crank to be engaged by said spring drive crank to enforce pivotal movement of said switch drive crank at a predetermined angular position of said spring drive crank;

means to couple said spring drive crank to said motor drive crank for effecting pivotal movement of said spring drive crank to effect the movement of the axis of said spring through the line of centers to release the stored energy in said spring to drive said switch drive crank in a pivotal movement thereby rotating the drive shaft for effecting relative movement between the switch contacts; and, means for deactivating said power actuator after the axis of the spring has been moved through the line of centers.

11. A drive for a high-speed disconnect switch according to claim 10 wherein said spring drive crank is configured as a sector having its peripheral center portion relieved to form first and second end abutments; and, said engaging means carried by said switch drive crank rides on the periphery of the relieved portion of said spring drive crank with said end abutments operating to impart movement to said switch drive crank.

12. A drive for a high-speed disconnect switch according to claim 11 wherein said engaging means carried by said switch drive crank receives one end of a first connecting rod, said first connecting rod having its opposite end connected to the drive shaft of a second phase disconnect switch; and, a second connecting rod having one end secured to said engaging means, said second connecting rod having its opposite end connected to the drive shaft of a third-phase disconnect switch;

whereby the disconnect switches of all phases will be operated simultaneously in a switch closing or opening operation.

13. In combination with a disconnect switch having a relatively stationary contact and a cooperable movable contact movable into and out of contacting engagement with said stationary contact, a rotatable operating shaft, means for effecting opening movement and closing movement respectively between said movable and stationary contacts when said operating shaft is rotated in first and in second directions, a switch drive crank affixed to said operating shaft, a spring drive crank rotatable about the axis of said operating shaft, an overcenter compression spring having one end pivotally connected at a fixed point and being pivotally connected at the other end to said spring drive crank, means for providing a lost-motion connection between said switch drive crank and said spring drive crank, a drive crank rotatable about the axis of said operating shaft, means for providing a lost motion connection between said drive crank and said spring drive crank, reversible power means for selectively rotating said drive crank in a switch opening direction or in a switch closing direction to an overcenter position wherein said compression spring is charged and said other end thereof has crossed an imaginary line intersecting said fixed point and the axis of said shaft but said contacts have not been opened or closed, and means responsive to said compression spring being moved to said overcenter position for disabling said power means in either direction of rotation of said shaft, said compression spring, upon attaining said overcenter position, rapidly actuating said switch drive crank to separate said contacts with high velocity in a switch opening operation or to engage said contacts with high velocity in a switch closing operation.

* * * * *